US007374414B2

(12) United States Patent
Römer et al.

(10) Patent No.: US 7,374,414 B2
(45) Date of Patent: May 20, 2008

(54) ROTARY PRESS

(75) Inventors: Harald Römer, Reinbek (DE); Ulrich Zeuschner, Schwarzenbek (DE); Thorsten Ehrich, Witzhave (DE); Kurt Marquardt, Hamburg (DE)

(73) Assignee: Fette GmbH, Schwarzenbek (DE)

( * ) Notice: Subject to any disclaimer, the term of this patent is extended or adjusted under 35 U.S.C. 154(b) by 0 days.

(21) Appl. No.: 11/433,279

(22) Filed: May 12, 2006

(65) Prior Publication Data

US 2006/0254438 A1 Nov. 16, 2006

(30) Foreign Application Priority Data

May 12, 2005 (DE) ..... 10 2005 021 926

(51) Int. Cl.
*B30B 11/08* (2006.01)

(52) U.S. Cl. ..... 425/345; 100/178; 100/223; 100/906

(58) Field of Classification Search ..... 100/138, 100/144, 178, 185, 906, 918, 223; 425/343, 425/345

See application file for complete search history.

(56) References Cited

U.S. PATENT DOCUMENTS 2,944,493 A 7/1960 Bailey et al. ..... 107/17
3,063,390 A * 11/1962 Frank ..... 425/134
3,171,366 A * 3/1965 Wichart ..... 425/134
6,068,465 A * 5/2000 Wilson ..... 425/193

FOREIGN PATENT DOCUMENTS

DE 1 427 423 3/1962

* cited by examiner

*Primary Examiner*—Jimmy T. Nguyen
(74) *Attorney, Agent, or Firm*—Vidas, Arrett & Steinkraus, P.A.

(57) ABSTRACT

Rotary press with a rotor, rotatingly drivable around a vertical axis of rotation, which has a die plate with die bores and upper and lower punches guided in guidings, radial cams for the upper and lower punches, at least one compression station with upper and lower pressing roller, at least one filling equipment and at least one stripping device for pressed articles which are ejected from the die bores, characterized in that the rotor has an annular plane situated radially outside of the graduated circle for the die bores, which is concentric to the axis of rotation and is lowered with respect to the upper side of the die plate about a predetermined degree, first deflection portion direct the ejected pressed articles to the annular plane and second deflection portion direct the pressed articles from the annular plane towards the outside.

4 Claims, 2 Drawing Sheets

ROTARY PRESS

CROSS-REFERENCE TO RELATED APPLICATIONS

Not applicable.

STATEMENT REGARDING FEDERALLY SPONSORED RESEARCH

Not applicable.

BACKGROUND OF THE INVENTION

Rotary presses for the manufacture of tablets and other pressed articles are known since a long time. Generally, they have a rotor which is rotatingly drivable around a vertical axis of rotation, which has a die plate with die bores arranged on a graduated circle, as well as lower and upper punches and guidings for them. Further, radial cams for lower and upper punches as well as at least one compression station with upper and lower pressing rollers belong to the rotary press. Such a rotary press is further equipped with a filling station, which automatically fills material that is to be pressed into the die bores, and also with a stripping device, which strips off pressed articles which were ejected from the lower punches from the upper side of the die plate into a discharge path. At the end of the discharge path there is a sacking equipment. At option, the pressed articles can also be directed towards an inspection station.

In the known case, the stripping of pressed articles in the operation of such a rotary press has to take place between the always last compression station and the filling equipment. In the filling equipment, the refilling of the die bores is performed. Therefore, stripping devices are provided at approximately opposite sides in a twin station rotary press. As a consequence, corresponding space has to be provided for the removal of the pressed articles, which is not available in some cases.

The present invention is based on the objective to create a rotary press in which the pressed articles can be taken off at a desired location on the perimeter of the rotor.

BRIEF SUMMARY OF THE INVENTION

In the rotary press according to the present invention, the rotor is provided with an annular plane radially outside of the graduated circle for the die bores, which extends preferably in the horizontal direction and which is concentric to the axis of rotation of the rotor. The annular plane is lowered about a predetermined degree with respect to the upper side of the die plate. First deflection means direct the pressed articles ejected from the die bores towards the annular plane, and second deflection means direct the pressed articles from the annular plane towards the outside to a discharge path.

As soon as the pressed article is directed to the lower annular plane in the rotary press according to the invention, it can move freely without interference of a compression station or a filling equipment and then it can be guided towards the outside at a desired location, with the aid of the second stripping device. Thus, the rotary press according to the invention has the advantage that pressed articles can be transferred into discharge means at arbitrary locations in a manner which is independent from their processing equipments. No particular drive is needed for this.

The present invention is particularly advantageous for multiple station rotary presses, because through this, the discharge of the pressed articles can be performed at only one location on the perimeter of the rotor. As a consequence, peripheral devices are necessary at only one side of the press. The space required for the installation of the rotary press according to the invention, for the peripheral devices and perhaps a container, when a container for the pressed articles is used, is a minimal one.

An example of realisation of the invention is explained in more detail by means of drawings below.

DETAILED DESCRIPTION OF THE INVENTION

Figure 1:
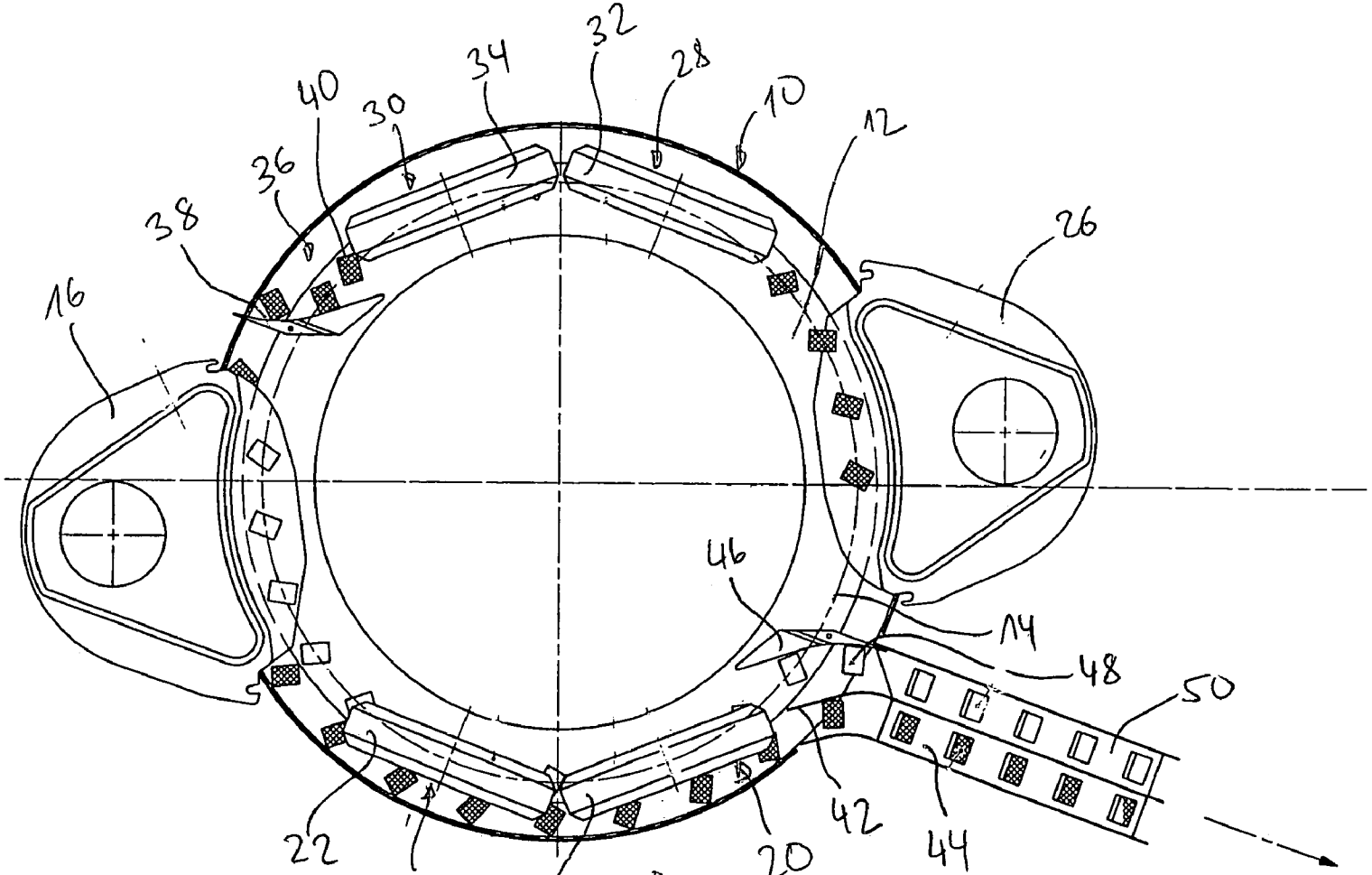
FIG. 1 shows the schematic top view on the rotor of a twin station rotary press.
Figure 2:
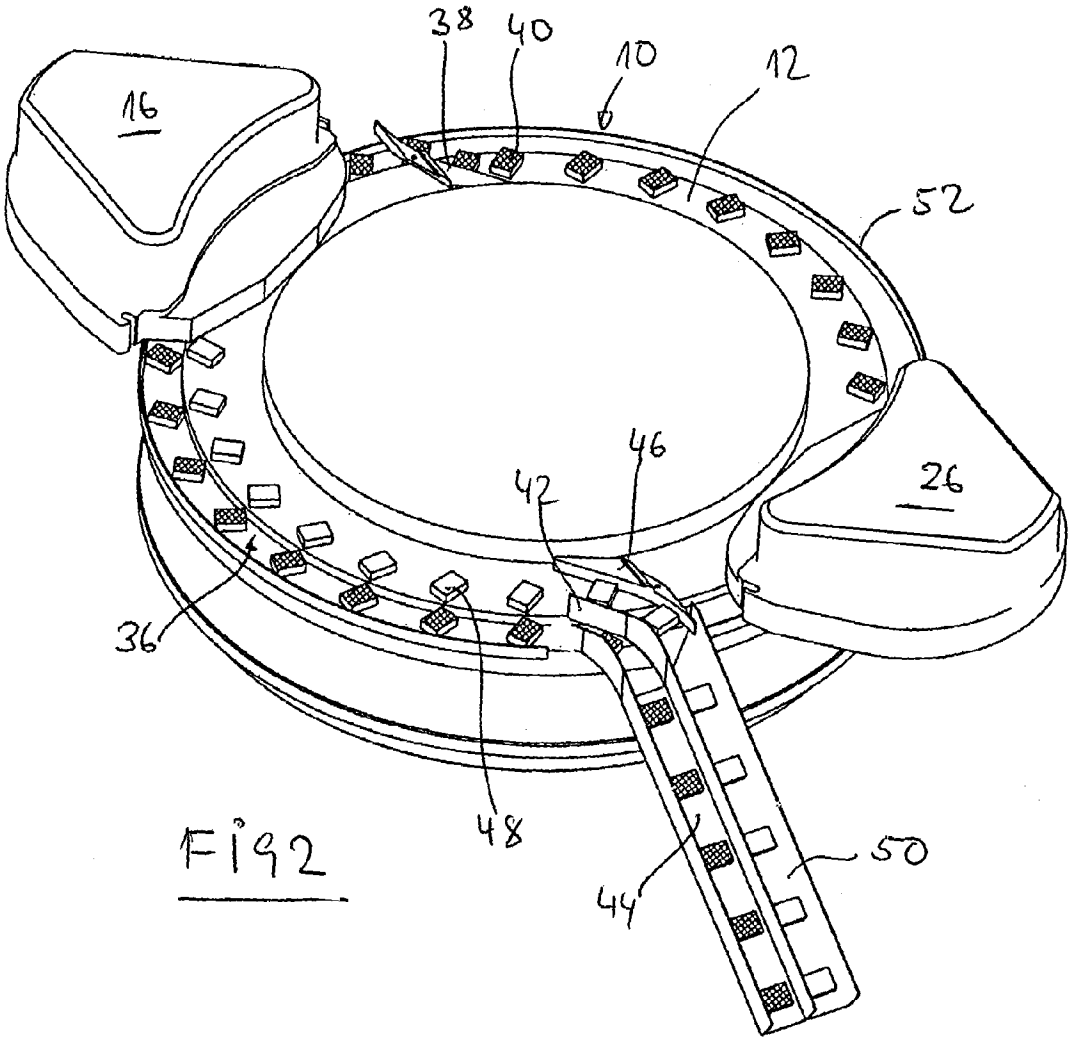
FIG. 2 shows the rotor according to FIG. 1 in a perspective representation without the compression stations.

While this invention may be embodied in many different forms, there are described in detail herein a specific preferred embodiment of the invention. This description is an exemplification of the principles of the invention and is not intended to limit the invention to the particular embodiment illustrated In FIGS. 1 and 2, a rotor 10 of a twin station rotary press is shown, which itself is only represented in outlines. The rotor is rotatingly drivable around a vertical axis (perpendicular to the plane of projection in FIG. 1) with the aid of a rotational drive. Upper and lower punches belong to the rotor 10, which are guided in punch guidings. Both are also not drawn. The rotor has a die plate 12, which has a series of die bores on a graduated circle 14. The die bores are not shown, but only the pressed articles, which are formed rectangular in the present example. A first filling equipment 16 is assigned to the rotor 10, with the aid of which powder that is to be pressed is filled into the die bores. In the realisation example, the rotor rotates counter-clockwise. In the sense of rotation, a pre-compression station 18 and a main compression station 20 are assigned to the rotor 10 thereafter, from each one of which can be seen an upper pressing roller 22 and 24, respectively. As is known, the pressing rollers co-operate with the pressing punches to compress the material in the die bores.

A second filling equipment 26 is located diametrically opposite to the first one and is followed in the sense of rotation by a second pre-compression station 28 and a main compression station 30, from each one of which can be recognised only the upper pressing roller 32 and 34, respectively.

An annular plane 36 is provided on the rotor 10 radially outside of the die plate 12, which runs concentrically to the axis of rotation and is situated lower than the upper side of the die plate 12.

Between the second main compression station 30 and the first filling equipment 16, a deflector plate 38 is arranged somewhat above the die plate. It serves to direct the first pressed articles 40 ejected from the lower punches from the upper side of the die plate 12 to the annular plane 36. Through this, the first pressed articles 40 move freely, unhindered by the first filling equipment 16 and the first pre-compression station 18 and the first main compression station 20. A second deflection portion 42, arranged shortly above the horizontal annular plane 36, directs the first pressed articles 40 from the annular plane 36 into a first discharge path 44. Shortly behind the second deflection means in the sense of rotation, a third deflection portion 46 is provided in the form of a stripping device, which redirects second pressed articles 48 from the upper side of the die plate 12 into a second discharge path 50, which is arranged parallel to the first channel 44.

As can be recognized, the first pressed articles 40 are formed in the compression station 28, 30 and ejected after the main compression station 30 and then they are directed to the annular plane 36. The second pressed articles 48 are formed in the second compression station 18, 20 and the ejected pressed articles are usually directed into the discharge path 50 by stripping device 46. As described, the pressed articles 40 on the annular plane 36 are directed into the discharge path 44. As a consequence, it is possible through the described measure to perform the removal of the pressed articles 40, 48, on the same location on the perimeter of rotor 10.

In order to prevent that the pressed articles side-slip down from the annular plane 36, the latter has a raised edge 52.

It is to be understood that the described principle is not only applicable to twin station rotary presses, but also to triple or multiple station rotary presses.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction. In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. Rotary press comprising a rotor, rotatingly drivable around a vertical axis of rotation, for pressed articles, the rotor having a die plate, the rotary press further comprises at least one compressing station with upper pressing rollers and at least one filling equipment, characterized in that the rotor (10) has an annular plane (36) situated radially outside of a graduated circle of the die plate (14), the annular plane being concentric to the axis of rotation and an upper surface of the annular plane is lowered with respect to an upper side of the die plate (12) about a predetermined degree, first deflection means (38) are provided which direct the pressed articles from the die plate to the annular plane (36) and second deflection means (42) are provided which direct the pressed articles from the annular plane (36) towards an outside of the press.

2. Rotary press according to claim 1, characterized in that the pressed articles (40, 48) have a thickness and the degree of lowering of the annular plane (36) corresponds to at least the thickness of the pressed articles (40, 48).

3. Rotary press according to claim 1, wherein the at least one compression station comprises at least two compression stations (28, 30, 18, 20) spaced apart in a circumferential direction, and the at least one filling equipments comprises two filling equipments (16, 26) spaced apart in a circumferential direction, the first deflection means (38) is arranged between the first compression station (28, 30) and the first filling equipment (16), and the second deflection means (42) is arranged between the second compression station (18, 20) and the second filling equipment (26), and a third deflection means (46) is arranged between the second deflection means (42) and the second filling equipment (26)), which directs the ejected pressed articles from the upper side of the die plate (12) towards the outside.

4. Rotary press according to claim 3, characterized in that the second and third deflection means (42, 46) are assigned to two parallel discharge paths (44, 50).

* * * * *